US009464846B2

(12) United States Patent
Quintanilla Montemayor

(10) Patent No.: US 9,464,846 B2
(45) Date of Patent: Oct. 11, 2016

(54) REFRACTORY DELTA COOLING SYSTEM

(71) Applicant: Nucor Corporation, Charlotte, NC (US)

(72) Inventor: Omar A. Quintanilla Montemayor, Blytheville, AR (US)

(73) Assignee: NUCOR CORPORATION, Charlotte, NC (US)

( * ) Notice: Subject to any disclaimer, the term of this patent is extended or adjusted under 35 U.S.C. 154(b) by 131 days.

(21) Appl. No.: 14/081,739

(22) Filed: Nov. 15, 2013

(65) Prior Publication Data

US 2015/0137432 A1 May 21, 2015

(51) Int. Cl.
*F27D 9/00* (2006.01)
*F27D 1/18* (2006.01)

(52) U.S. Cl.
CPC . *F27D 9/00* (2013.01); *F27D 1/18* (2013.01); *F27D 2009/0013* (2013.01)

(58) Field of Classification Search
CPC ..... F27D 9/00; F27D 2009/0016; F27D 2009/0013; F27D 11/00
USPC ..... 266/241; 373/74
See application file for complete search history.

(56) References Cited

U.S. PATENT DOCUMENTS

| | | | | |
|---|---|---|---|---|
| 1,410,086 | A * | 3/1922 | Weidenthal | 432/238 |
| 4,423,513 | A | 12/1983 | De Long | |
| 4,434,495 | A | 2/1984 | Tomizawa et al. | |
| 4,491,952 | A * | 1/1985 | Honkaniemi et al. | 373/74 |
| 4,633,480 | A | 12/1986 | Bleimann | |
| 4,715,042 | A | 12/1987 | Heggart et al. | |
| 4,813,055 | A | 3/1989 | Heggart et al. | |
| 4,815,096 | A | 3/1989 | Burwell | |
| 4,852,120 | A * | 7/1989 | Udo | 373/95 |
| 5,115,184 | A | 5/1992 | Arthur et al. | |
| 5,290,016 | A | 3/1994 | Elsner | |
| 5,648,981 | A | 7/1997 | Miner, Jr. et al. | |
| 5,785,517 | A | 7/1998 | Gray et al. | |
| 5,923,697 | A | 7/1999 | Pavlicevic et al. | |
| 5,999,558 | A | 12/1999 | Miner, Jr. et al. | |
| 6,246,712 | B1 | 6/2001 | Whyte et al. | |
| 6,404,799 | B1 | 6/2002 | Mori et al. | |
| 6,870,873 | B2 | 3/2005 | Lyons et al. | |
| 7,625,517 | B2 | 12/2009 | Arthur et al. | |
| 2011/0243179 | A1 | 10/2011 | Schwer et al. | |
| 2015/0137432 | A1* | 5/2015 | Quintanilla Montemayor | 266/46 |

FOREIGN PATENT DOCUMENTS

| | | | |
|---|---|---|---|
| EP | 0171905 | A1 | 2/1986 |
| WO | WO 95/22732 | A1 | 8/1995 |
| WO | WO 2004/106830 | A2 | 12/2004 |
| WO | WO 2006/117426 | A1 | 11/2006 |
| WO | WO 2012/123041 | A1 | 9/2012 |

* cited by examiner

*Primary Examiner* — Scott Kastler
(74) *Attorney, Agent, or Firm* — Moore & Van Allen PLLC; Jeffrey R. Gray

(57) ABSTRACT

Embodiments of the present invention comprise a refractory delta made from a refractory material having a cold-face side and a hot-face side. One or more electrode apertures are located in the refractory delta for receiving one or more electrodes. One or more cooling apertures extend from the cold-face side of the refractory material to adjacent the hot-face side of the refractory material. The one or more cooling apertures may further comprise a copper tube. A cooling system delivers a cooling liquid to the one or more cooling apertures, and the cooling liquid draws heat from the adjacent refractory material, including the hot-face side, and evaporates to allow replacement cooling liquid to further draw heat from the adjacent refractory material.

21 Claims, 13 Drawing Sheets

REFRACTORY DELTA COOLING SYSTEM

FIELD

The present invention is related to the field of refractory material used in electric arc furnaces (EAFs), and more specifically refractory deltas used in the roofs of EAFs.

BACKGROUND

The roof (i.e., lid, cover, or the like) of an EAF may be made of steel or other like metal that is water-cooled, made of refractory material, or have sections made of steel that are water-cooled, sections made of refractory material, or sections made of both steel and refractory material (e.g., outer steel roofs with inner refractory material). Roofs having refractory material are designed with a thermal conductivity and thickness of the refractory material such that the refractory material acts as an insulator to prevent heat within the EAF from escaping and damaging components located on the outside of the EAF (e.g., EAF outer walls, electrical components for the electrodes, exhaust ducts, or the like). The refractory material is exposed to various sources of heat that may cause damage to the refractory material, and thus wear away the refractory material. For example, the refractory material may be damaged by heat created by the arc of the electrode, by heat created in the chemical reaction in the conversion of CO to $CO_2$ as the CO rises in the furnace, combusts, and is converted to $CO_2$, and by the heat created by the combustion of gas injected into the EAF. The roof is especially susceptible to damage when the EAF is filled with scrap steel and the arc formed between the electrodes and scrap steel is located near the roof of the furnace (e.g., during the beginning of melting process in single charge EAFs or after each charge of scrap steel in EAFs that receive multiple charges).

SUMMARY OF THE EMBODIMENTS OF THE INVENTION

The following presents a simplified summary of one or more embodiments of the present invention, in order to provide a basic understanding of such embodiments. This summary is not an extensive overview of all contemplated embodiments, and is intended to neither identify key or critical elements of all embodiments nor delineate the scope of any or all embodiments. Its sole purpose is to present some concepts of one or more embodiments of the present invention in a simplified form as a prelude to the more detailed description that is presented later.

Embodiments of the invention comprise refractory deltas with one or more apertures (e.g., cooling apertures) formed at least partially into the refractory deltas, and in some embodiments the one or more apertures are through holes that pass completely through the refractory deltas. The refractory deltas are used within roofs of EAFs in order protect the other components of the roofs by helping to avoid direct contact between the arcs formed by the electrodes that pass through the refractory deltas and the other parts of the roofs. The refractory deltas are consumed by the heat in the EAFs and wear away as they are exposed to various sources of heat from the EAFs. One source of heat that is particularly damaging is the electrode arcs generated by the electrodes. During operation of the EAFs the electrodes create arcs with the scrap steel within the EAFs and the heat from the arcs damage the refractory deltas. The refractory deltas are particularly susceptible when the scrap steel is located near the roofs, for example at the beginning of the melting process when the EAFs are fully charged with scrap steel, and the arcs are located near the refractory deltas. During operation of the EAFs the one or more refractory apertures may receive water from a cooling system. The water draws heat from the surrounding refractory material in the refractory deltas as the water passes through the one or more apertures. The water evaporates as it passes through the one or more apertures and when it enters the EAFs. The water helps to remove heat from the hot-faces of the refractory deltas that are exposed to the inside of the EAFs. The one or more apertures may also include tubes (e.g., copper tubes) that help to further facilitate removing heat from the hot-faces of the refractory deltas out through the cold-faces of the refractory deltas. The refractory deltas may further include channels that help direct the water to the one or more apertures.

One embodiments of the invention is a refractory delta comprising refractory material having a cold-face side and a hot-face side; one or more electrode apertures for receiving one or more electrodes; one or more cooling apertures extending from the cold-face side of the refractory material to adjacent the hot-face side of the refractory material; and wherein the one or more cooling apertures are configured to receive a cooling liquid that draws heat from the refractory material and evaporates to allow replacement cooling liquid to further draw heat from the refractory material.

In further accord with an embodiment of the invention, the one or more cooling apertures are through holes that extend from the cold-face side through the hot-face side of the refractory material.

In another embodiment, the refractory delta further comprises a copper tube in at least a portion of one or more of the one or more cooling apertures.

In yet another embodiment, the refractory delta further comprises a channel located in the cold-face side of the refractory material; wherein the channel communicates with the one or more cooling apertures; and wherein the channel directs water to the one or more cooling apertures.

In still another embodiment of the invention, the refractory delta is configured for use in a roof of an electric arc furnace (EAF) by receiving cooling liquid from a cooling system, wherein the cooling liquid comprises water and the water is supplied from a water supply manifold or an electrode cooling system.

Another embodiment of the invention is a roof for an electric arc furnace (EAF), comprising an outer roof section and an inner roof section. The inner roof section comprises a refractory material having a cold-face side and a hot-face side; one or more electrode apertures for receiving one or more electrodes; one or more cooling apertures extending from the cold-face side of the refractory material to adjacent the hot-face side of the refractory material; and wherein the one or more cooling apertures are configured to receive a cooling liquid that draws heat from the refractory material and evaporates to allow replacement cooling liquid to further draw heat from the refractory material.

In further accord with an embodiment of the invention, the one or more cooling apertures are through holes that extend from the cold-face side through the hot-face side of the refractory material.

In another embodiment of the invention, the roof further comprises a copper tube in at least a portion of one or more of the one or more cooling apertures.

In yet another embodiment of the invention, the roof further comprises a channel located in the cold-face side of the refractory material; wherein the channel communicates with the one or more cooling apertures; and wherein the channel directs water to the one or more cooling apertures.

In still another embodiment of the invention, the refractory delta is configured to receive the cooling liquid from a cooling system, wherein the cooling liquid comprises water and the water is supplied from a water supply manifold or an electrode cooling system.

Another embodiment of the invention is a refractory delta cooling system comprising an electric arc furnace (EAF) comprising a roof with an outer roof section and an inner roof section. The inner roof section comprises a refractory material; a cold-face side and a hot-face side; one or more electrode apertures for receiving one or more electrodes; one or more cooling apertures extending from the cold-face side of the refractory material to adjacent the hot-face side of the refractory material; wherein the one or more cooling apertures are configured to receive a cooling liquid that draws heat from the refractory material and evaporates to allow replacement cooling liquid to further draw heat from the refractory material. The refractory delta cooling system further comprises a cooling system, wherein the cooling system directs a cooling liquid to the one or more cooling apertures.

In further accord with an embodiment of the invention, the one or more cooling apertures are through holes that extend from the cold-face side through the hot-face side of the refractory material.

In another embodiment of the invention, the inner roof section further comprises a copper tube in at least a portion of one or more of the one or more cooling apertures.

In still another embodiment of the invention, the inner roof section further comprises a channel located in the cold-face side of the refractory material; wherein the channel communicates with the one or more cooling apertures; and wherein the channel directs water to the one or more cooling apertures.

Another embodiment of the invention is a method for cooling a refractory delta comprising applying a cooling liquid to a cold-face of refractory material of the refractory delta in a roof of an electric arc furnace (EAF); capturing the cooling liquid in one or more cooling apertures, wherein the cooling apertures extend from the cold-face side of the refractory material to adjacent a hot-face side of the refractory material; applying additional cooling liquid to the cold-face of the refractory material in the roof of the EAF as the cooling liquid evaporates from the one or more cooling apertures; and capturing the additional cooling liquid in the one or more cooling apertures.

In further accord with an embodiment of the invention, the one or more cooling apertures are through holes that extend from the cold-face side through the hot-face side of the refractory material.

In another embodiment of the invention, the one or more cooling apertures comprise a copper tube in at least a portion of the one or more cooling apertures; and wherein capturing the cooling liquid and the additional cooling liquid in the one or more cooling apertures comprises capturing the cooling liquid and the additional cooling liquid in the copper tube.

In still another embodiment of the invention, the refractory delta comprises a channel located in the cold-face side of the refractory material that communicates with the one or more cooling apertures; and wherein applying the cooling liquid to the cold-face of the refractory delta in the roof of the EAF comprises applying the cooling liquid to the channel that directs the cooling liquid to the one or more cooling apertures.

In yet another embodiment of the invention, applying the cooling liquid and applying the additional cooling liquid comprises applying water and the water is supplied from a water supply manifold or an electrode cooling system.

Another embodiment of the invention is a refractory delta cooling system, comprising an electric arc furnace (EAF) comprising an outer roof section and an inner roof section. The inner roof section is a refractory delta and comprises a refractory material; a cold-face side and a hot-face side; and one or more electrode holes for receiving one or more electrodes. The refractory delta cooling system further comprises a cooling system, wherein the cooling system directs a cooling liquid to the cold-face side of the refractory delta, and wherein the cooling liquid facilitates the transfer of heat from the hot-face side to the cold-face side and evaporates to allow replacement cooling liquid to further facilitate the transfer of heat from the hot-face side to the cold-face side.

To the accomplishment of the foregoing and the related ends, the one or more embodiments of the invention comprise the features hereinafter fully described and particularly pointed out in the claims. The following description and the annexed drawings set forth certain illustrative features of the one or more embodiments. These features are indicative, however, of but a few of the various ways in which the principles of various embodiments may be employed, and this description is intended to include all such embodiments and their equivalents.

BRIEF DESCRIPTION OF THE SEVERAL VIEWS OF THE DRAWINGS

The foregoing and other advantages and features of the invention, and the manner in which the same are accomplished, will become more readily apparent upon consideration of the following detail description of the invention taken in conjunction with the accompanying drawings, which illustrate embodiments of the invention and which are not necessarily drawn to scale, wherein.

DETAILED DESCRIPTION OF EMBODIMENTS OF THE INVENTION

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Figure 1:
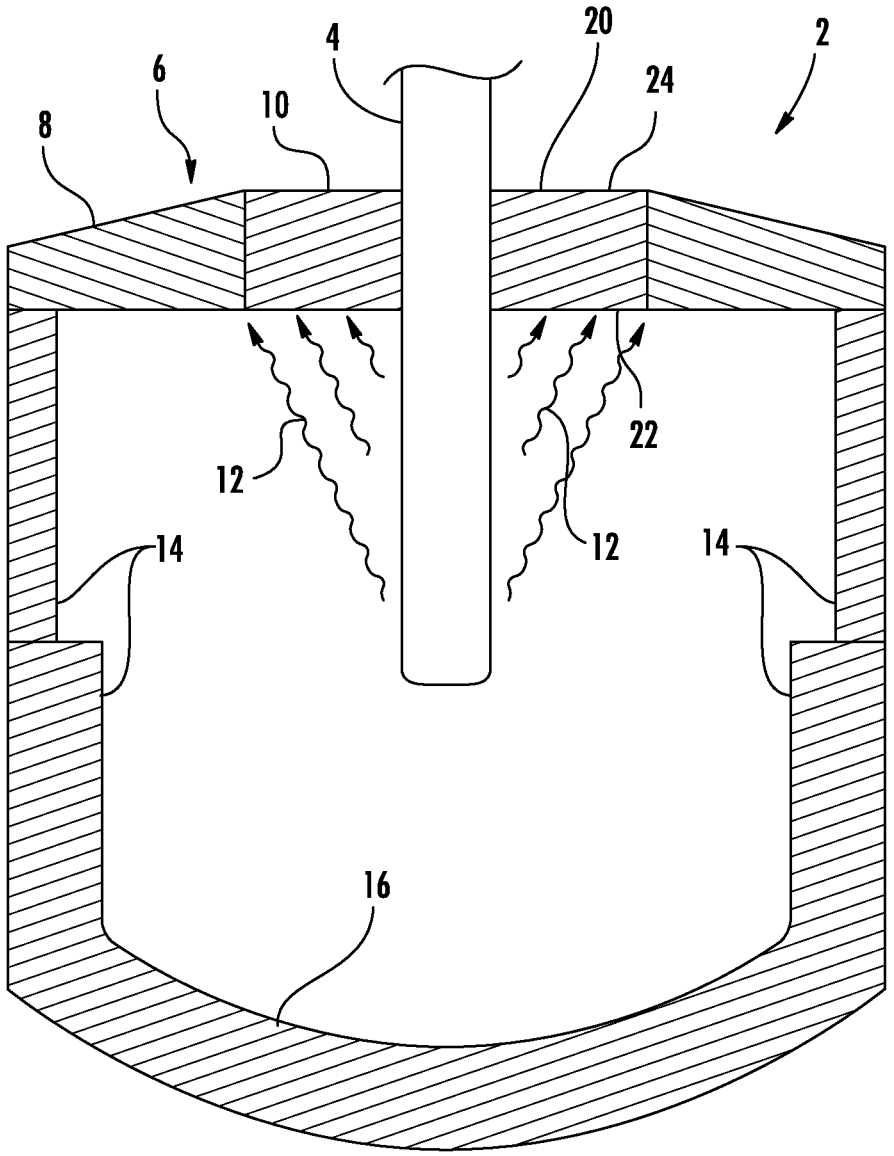
FIG. 1 illustrates a cross-sectional view of an EAF having a roof with a refractory delta, in accordance with an embodiment of the invention.

FIG. 1 illustrates a cross-sectional representation of an EAF 2 with a single electrode 4. However, in other embodiments of the invention the EAF 2 may have multiple electrodes 4. The one or more electrodes 4 pass through the EAF roof 6 and are used to create an arc with the scrap steel, which melts the scrap steel within the EAF 2 using the current passing through the scrap steel and the radiant heat 12 emitted from the arc. The radiant heat 12 from the one or more electrode arcs may damage the EAF roof 6, and as such the EAF roof 6 may be made of steel (or other like material) that is liquid-cooled, such as water-cooled using spray cooling, pipe cooling, or other like means. Due to the proximity of the location of the one or more electrodes 4 near the center of the EAF roof 6, the interior of the EAF roof 6 may be more susceptible to damage from the heat from the arcs of the one or more electrodes 4 than the outer portions of the EAF roof 6. As such, as illustrated in FIG. 1, the EAF roof 6 may have an outer roof 8 portion and an inner roof 10 portion. Both the outer roof 8 and the inner roof 10 may be made of steel and water-cooled using one or more water-cooled systems. In addition, the inner roof 10 may be subjected to more water-cooling than the outer roof 8 due to the higher temperatures to which the inner roof 10 is exposed.

In other configurations, instead of using a water-cooled steel inner roof 10, the inner roof 10 may be a refractory delta 20 made of refractory material. The refractory delta 20 has a hot-face side 22 that is exposed to the inside of the EAF 2 and a cold-face side 24. The refractory delta 20 is used to improve the insulation of the inner roof 10 and avoid direct contact between the heat from the arcs of the electrodes and the outer roof 8 (e.g., the water-cooled outer roof). Due to the close proximity of the refractory delta 20 with the arcs of the one or more electrodes 4, particularly during the initial stages of melting when the scrap steel is close to the EAF roof 6, the refractory delta is more susceptible to heat, and thus wears away at a faster rate than the refractory material at other locations within the furnace, such as the outer roof 8 (if applicable), EAF walls 14, and/or floor 16. However, since the heat is more concentrated at the location of the refractory delta 20, the refractory delta 20 improves the life of the EAF roof 6 and reduces the downtimes of the EAF 2 for repairs because the refractory delta 20 can be replaced when damaged instead of having to repair or rebuild an entire EAF roof 6 that is water-cooled or made of refractory material throughout. As such, when the refractory delta 20 is consumed and wears out to a point where it may no longer be effective in providing the desired insulation, the refractory delta 20 may be removed and replaced with a new refractory delta 20. In other embodiments of the invention refractory material may be partially repaired with refectory mixes to fill crack and replace worn sections of the refractory material. While the replacement or repair process may be quicker and less expensive than repairing a water cooled roof, or rebuilding a roof made of refractory bricks, it still results in downtime of the operation of the EAF and the expense of replacing or repairing refractory deltas 20.

In other embodiments of the invention the outer roof 8 may be at least partially made of refractory material (e.g., refractory material be used in addition with the water-cooled roof). In still other embodiments of the invention, other cooling liquids other than water may be used to cool one or more portions of the EAF roof 6.

Figure 2:
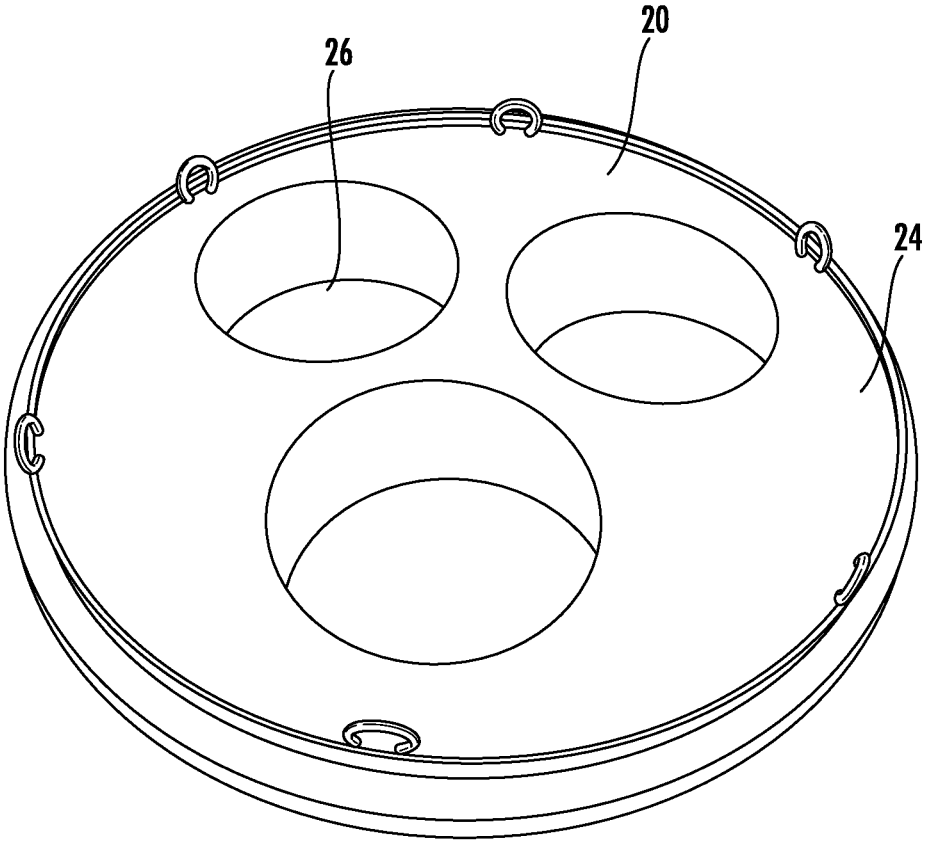
FIG. 2 illustrates a perspective view of a refractory delta for a roof in an EAF, in accordance with an embodiment of the invention.

As illustrated in FIG. 1 the refractory delta 20 may have a single refractory electrode aperture 26 to allow for the passage of the electrode 4 used to melt the scrap steel in the EAF 2. In other embodiments of the invention the EAF 2 may have more than one electrode 4, such as three electrodes 4, and as such the refractory delta 20 may have multiple electrode apertures 26, as illustrated by FIG. 2. The one or more electrode apertures 26 are through holes, and as such the one or more electrodes 4 are lowered and raised in and out of the EAF 2 through the one or more apertures 26 during the steelmaking process. For example, as the initial charge of the scrap steel begins to melt and the height level of the scrap steel in the EAF 2 is reduced the one or more electrodes 4 are lowered further into the EAF 2 in order to maintain the desired arc with the scrap steel. In addition to the steel outer roof 8 being water-cooled, the one or more electrodes 4 that pass through the refractory delta 20 may be water-cooled in order to prevent, reduce, or delay damage to the one or more electrodes 4 during the steelmaking process from the heat within the EAF (e.g., the radiant heat 12 from the arc, and other sources of heat).

Refractory deltas 20 wear differently depending on a number of wear factors, including but not limited to the specific process being used to make steel in the EAF 2, the location of the arcs created between the electrodes and the scrap steel based on the number of electrodes and the height of the scrap steel in the EAF, the chemical energy from the exothermic reaction in the conversion of CO to $CO_2$ (as well as the exothermic reaction of C and O into CO), combustion energy from the combustion of gas injected into the EAF 2, the chemical composition of the slag and steel that is based on the composition of the initial scrap steel, alloying elements, and carbon sources, the heat from the gas burners, and/or the automation control of the EAF 2 during the steelmaking process. However, the radiant heat 12 from the arcs when they are located near the refractory deltas 20 may wear the refractory deltas 20 more than the other wear factors. The refractory deltas 20 wear faster (e.g., are degraded and/or consumed) when the arcs from the one or more electrodes are located near the EAF roof 6 because the refractory deltas 20 are directly exposed to the heat generated by the one or more arcs. As previously discussed the arcs are closer to the EAF roof 6 when the EAF 2 is charged with scrap steel (e.g., the first charge or subsequent additional charges) and the height level of the scrap steel is close to the EAF roof 6. Moreover, the wear patterns in the refractory delta 20 may be based in part on how many electrodes are used (e.g., one, two, three, or the like). For example, the arcs from multiple electrodes will wear a refractory delta 20 differently than a single arc from a single electrode. With respect to chemical energy, the more energy from exothermic reactions of the elements in the EAF 2, for example the conversion of CO to $CO_2$, the more wear may occur in the refractory deltas 20. In addition, the type of elements in the scrap steel and slag may further increase the wear of the refractory deltas 20. The slag may provide some insulation to the refractory deltas 20 when the refractory deltas 20 are covered in a layer of slag, and thus reduce the amount of wear in the refractory deltas 20. The composition and processing parameters may determine whether or not the slag covers at least a portion of the refractory deltas 20. For example if the carbon levels in the EAFs 2 are too low the slag may not foam and may not cover portions of the refractory deltas 20.

Due to the wear factors described above, temperature gradients may be created in the refractory delta 20 that cause hot-spots which are damaged more quickly than other sections of the refractory delta 20. Moreover, the hot-spots may occur at different locations within the refractory delta 20, or move to different locations within the refractory delta 20, as the wear factors change during a single use of the EAF 2 or between multiple uses of the EAF 2. As such the replacement or repair times for the refractory deltas 20 in various EAFs 2 will vary based on the different wear factors present in the various EAFs 2. As the refractory deltas 20 wear at the locations of the hot-spots, the refractory deltas 20 require replacement.

Since the refractory delta 20 is used to insulate the EAF 2 and protect the EAF 2 from the high temperatures created by the arcs of the electrodes 4 and other heating means (e.g., gas burners, or the like), the type refractory material and the thickness of the refractory delta 20 are chosen to achieve the desired balance between the cost of energy loss from heat escaping the EAF 2 and the cost of repairing and replacing the refractory delta 20 when it is damaged or worn out. As such, the refractory delta 20 may either be made of high thermal conductivity material where good heat transfer from the hot-face 22 to the cold-face 24 is desired, or be made from low-thermal conductivity material to help prevent energy from escaping the EAF 2. The thermal conductivity and thickness of the refractory delta 20 are typically set to provide energy conservation, as well as to transfer heat from the hot-face 22 to the cold-face 24 to prevent damage to the refectory delta 20 (or other components of the roof 6). Consequently, the type of refractory material used may require adjustment of the thickness of the refractory material in order to optimize the balance between energy conservation and life of the refractory material. Moreover, the dimensions of the refractory delta 20 may also vary based on the type of EAF 2 and the processing parameters for manufacturing different types of steel. In some embodiments of the invention the refractory delta may be made of one or more different types of refractory material.

In one embodiment, the refractory delta of the present invention may have a diameter of approximately 105 inches and a thickness of 18.75 inches. In other embodiments of the invention the dimensions may range from 60 to 140 inches for the diameter and 10 to 40 inches for the thickness. It should be understood that the invention described herein is not limited to a particular type of refractory delta 20, and that any refractory delta 20 of any size that is used with any type of EAF 2 may incorporate the one or more features of the invention described herein related to cooling the refractory delta 20.

Figure 3:
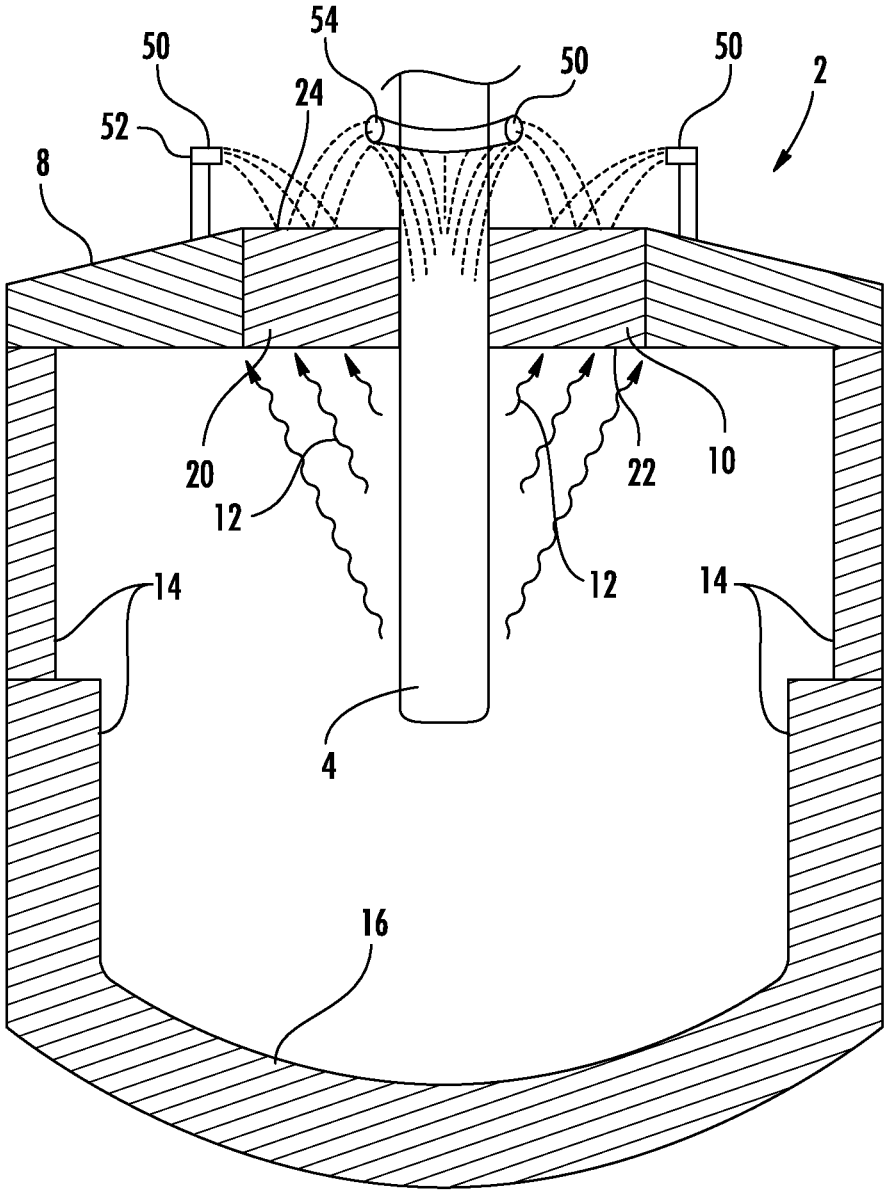
FIG. 3 illustrates a cross-sectional view of an EAF with a refractory delta that is water cooled, in accordance with an embodiment of the invention.
Figure 4:
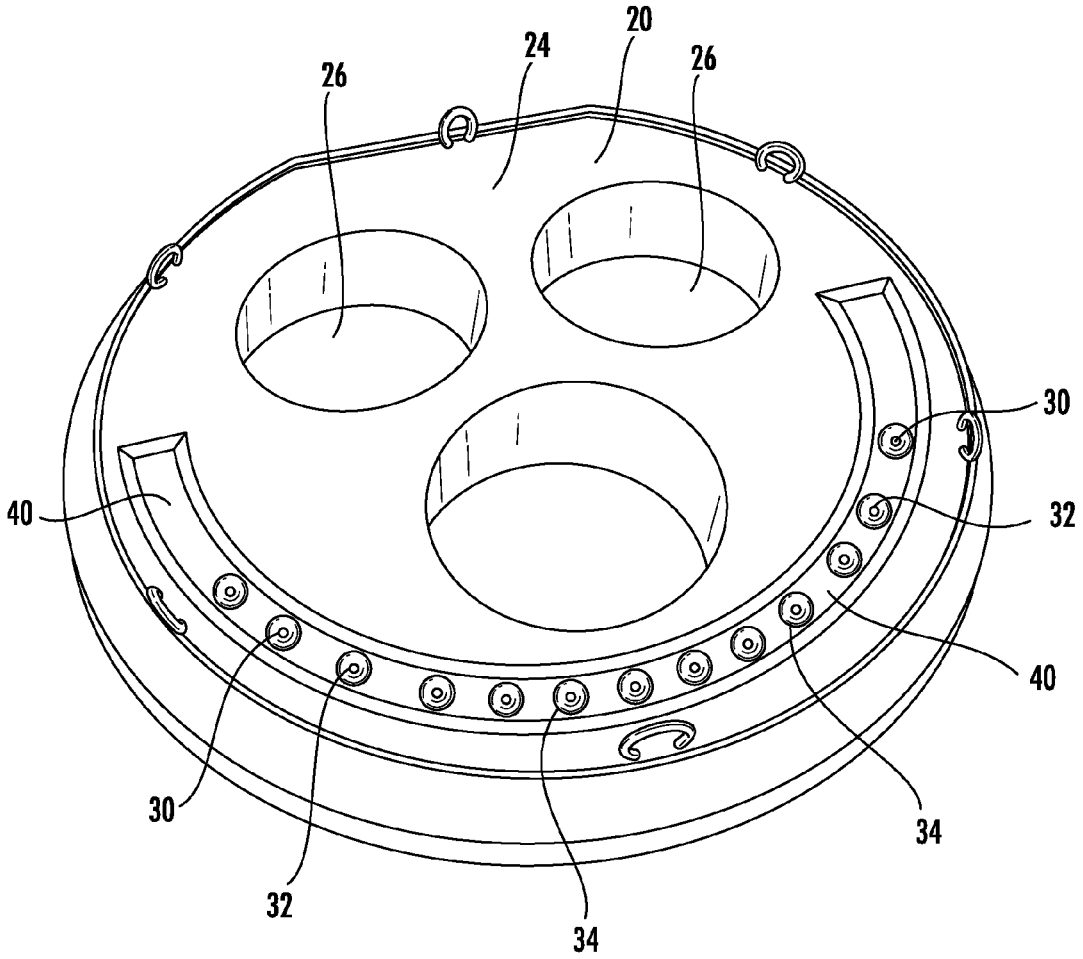
FIG. 4 illustrates a perspective view of a refractory delta with cooling apertures for a roof in an EAF, in accordance with an embodiment of the invention.

While internal water-cooled spraying, piping, or the like has been used to transfer heat from an interior wall of a steel furnace roof to the water being sprayed or piped through the interior of the steel roof, unlike the water-cooled steel roofs, in one embodiment of the present invention water may be sprayed directly on the cold-face 24 of the refractory delta 20 to help to transfer heat from the hot-face 22 of the refractory delta 20 to the cold-face 24 of the refractory delta 20, as illustrated in FIG. 3. While the term cold-face 24 is used herein to describe the outer surface of the refractory delta 20 the outer surface is not actually cold, but has a lower surface temperature with respect to the hot-face 22 of the refractory delta 20 that is exposed to the interior of the EAF 2. Applying water, or other cooling liquids, directly to the cold-face 24 of the refractory delta 20 cools the cold-face 24 of the refractory delta 20 and allows the heat from the hot-face 22 of the refractory delta 20 to transfer to the cold-face 24 more quickly than if no water was applied to the cold-face 20. Consequently, applying water directly on the cold-face 24 of the refractory delta 20 reduces the temperature of the hot-face 22 of the refractory delta 20. As the cooling water acts to reduce the temperature of the cold-face 24 of the refractory delta 20, the water temperature will increase and the water will turn into steam and evaporate off of the cold-face 24 of the refractory delta 20. The evaporation of the water allows more water to reach the cold-face 24 of the refractory delta 20 as additional water is applied. In some embodiments, some water may not evaporate immediately, and thus may run off of the refractory delta 20 and/or into the electrode apertures 26 in the refractory delta 20.

As illustrated in FIG. 3, the water cooling (or other cooling liquids) may be applied through the use of a cooling system 50 that sprays water onto the refractory delta 20, and particularly onto hot-spots of the refractory delta 20. For example, in one embodiment the cooling system 50 may be a refractory cooling system 52 attached to the EAF roof 6, hung over the EAF 2, or otherwise delivered to the surface of the refractory delta 10 through a manifold in one or more locations. In some embodiments of the invention the refractory cooling system 52 may be movable such that the direction of the water flow may be altered, for example, when hot-spots on the refractory delta 20 change based on the different wear factors. In some embodiments of the invention the refractory cooling system 52 may be automated such that the flow of water to the refractory delta 20 may be movable during operation of the EAF 2.

In other embodiments of the invention, the cooling system 50 may be part of the electrode cooling system 54, such that a portion of the water that is delivered to cool the one or more electrodes 4 may be directed (e.g., diverted, positioned, or the like) to the cold-face 24 of the refractory delta 20, and particularly to the hot-spots of the refractory delta 20. As was described with respect to the refractory cooling system 52 the electrode cooling system 54 (as well as other cooling systems 50) may be moveable such that the direction of the water flow may be altered, and in some embodiments may be automated.

As illustrated in FIGS. 4 through 12, in other embodiments of the invention one or more cooling apertures 30 may be located within the refractory delta 20. In one embodiment of the invention, the cooling apertures 30 may extend at least partially into the refractory delta 20 from the cold-face 24 of the refractory delta towards the hot-face 22 (e.g., 25, 30, 40, or 50 percent of the height of the refractory material). In other embodiments of the invention, the cooling apertures 30 may extend substantially into the refractory delta 20 to a location adjacent (e.g., proximate) to the hot-face 24 of the refractory delta 20 (e.g., more than 50, 75, 80, 90, 95, or other like percent of the height of the refractory material). In other embodiments of the invention, the cooling apertures 30 may extend completely through the refractory delta 20 from the cold-face 24 to the hot-face 22, and thus, open up into the EAF 2. The one or more cooling apertures 30 are located substantially vertically (e.g., perpendicular or generally perpendicular to the hot-face 22 and cold-face 24 of the refractory delta 20), however, in other embodiments of the invention the one or more cooling apertures 30 may be located at an angle within the refractory delta 20. In some embodiments of the invention the hot-face 22 and the cold-face 24 of the refractory delta 20 may be not be parallel to each other, and thus the one or more cooling apertures 30 may only be generally perpendicular to one face of the refractory delta 20, or may not be generally perpendicular to either of the faces of refractory delta 20. The one or more apertures 30 may have a circular, oval, square, rectangular, trapezoidal, hexagonal, non-uniform, or other like shape. In one embodiment of the invention, the diameter of the cooling apertures 30 may range from 0.1 to 5 inches, 1 to 3 inches, or may be 1.5 inches. In other embodiments of the invention the diameter of the cooling apertures may overlap or be outside of these ranges.

After the EAF 2 has been charged with scrap steel the electrodes 4 are inserted into the EAF 2 through the electrode apertures 26. When the electrodes 4 are turned on arcs are formed between the electrodes 4 and the scrap steel located near the EAF roof 6. At this point in the process the refractory delta 20 may be the most susceptible to wear and damage because this is when the arcs that are heating and melting the scrap steel are located the closest to the refractory delta 20. Consequently, water may be applied to the one or more cooling apertures 30 in order cool the refractory delta 20 near the hot face 22. As this point in the process the cooling apertures 30 are open to the EAF 2, and as such some of the water will enter the EAF 2 through the cooling apertures 30. However, the water that runs through the cooling apertures 30 will cool the refractory delta 20 and evaporate into steam as the water passes through the cooling apertures 30 and into the EAF 2.

Figure 12:
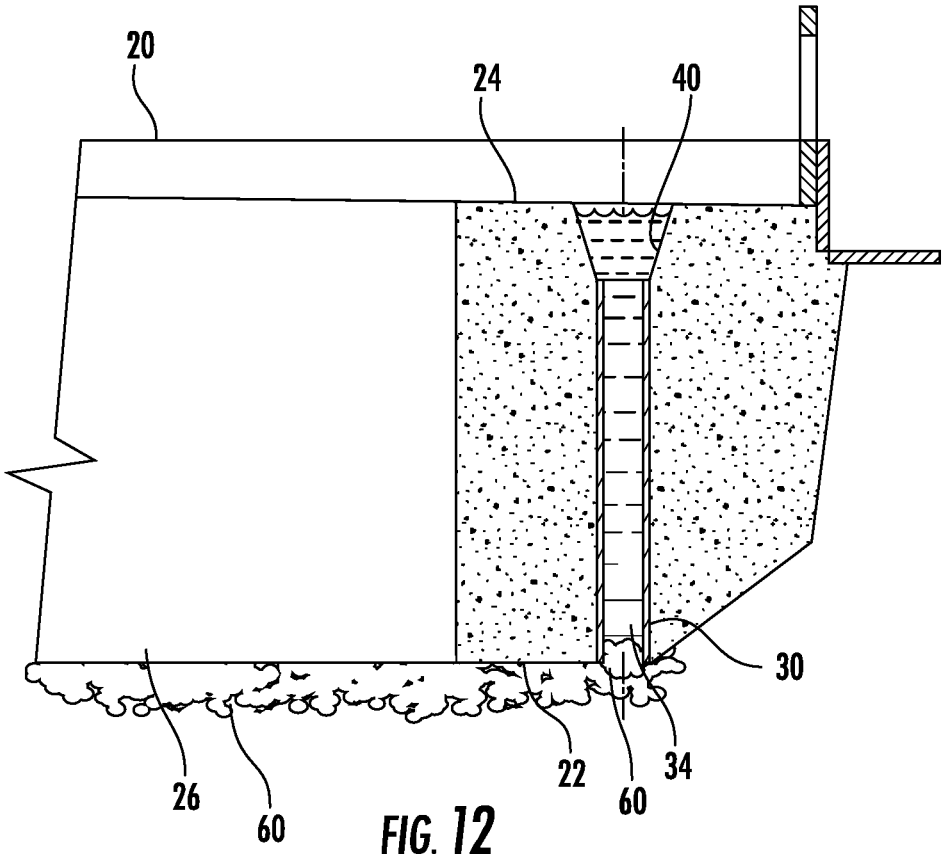
FIG. 12 illustrates a cross-sectional side view of a refractory delta with cooling apertures during one type of operation, in accordance with one embodiment of the invention.

During additional operation of the EAF 2, as the metal melts CO is formed from the reaction between carbon (e.g., in the scrap metal and other carbon sources) and oxygen. Other elements are also pulled out of the molten metal and combine with the CO to form a slag. The slag and/or dust from the scrap steel and other components added to the EAF 2 may build up on the surface of hot-face 22 of the refractory delta 20, or within a portion of the one or more cooling apertures 30, thus plugging or substantially plugging a least a portion of or all of the one or more cooling apertures 30. As such, in some embodiments of the invention, the water (or other cooling liquid) that is directed to the surface of the refractory delta 20 fills the one or more cooling apertures 30 in the refractory delta 20, as is illustrated in FIG. 12 and discussed in further detail below. Even though the water (or other cooling liquid) may become trapped within the plugged cooling apertures 30, the water helps to cool the refractory delta 20 near the cooling apertures 30 by drawing heat from the surrounding refractory material, including the hot-face 22 of the refractory delta 20. The high temperatures in the refractory delta 20 heats the water that has filled the one or more cooling apertures 30, and as the water evaporates out of the one or more cooling apertures 30 it is replaced by additional cooling water to continue the draw heat from the surrounding refractory delta 20. Consequently, even if the cooling apertures 30 are plugged with slag and/or dust the cooling apertures will still function to draw heat from the surrounding refractory material. Moreover, in some embodiments of the invention as the steelmaking process changes and the temperatures within the EAF 2 fluctuate, the solidified slag and/or dust that may plug the cooling apertures 30 may melt and unplug the one or more cooling apertures 30. For example, as CO is converted into $CO_2$ at or near the EAF roof 6, the heat from the conversion, or the hot $CO_2$ near the roof 6, may heat and melt some of the slag that may have solidified and covered the cooling apertures 30. In some embodiments of the invention, the slag and or dust may also be removed from the one or more cooling apertures 30 between heats of running the EAF on an as needed basis. For example, the one or more cooling apertures 30 may be cleared with an air wand or other like apparatus.

As illustrated in FIGS. 4-7 in some embodiments the one or more cooling apertures 30 may comprise a tube 34, for example a copper tube, which in addition to the water helps to remove heat from the surrounding refractory material, including the hot-face 22 of the refractory delta 20, and transfer it to the water in the one or more cooling apertures 30. In other embodiments of the invention the tube may be made of one or more different types of material that also act as a heat transfer conduit from the hot-face 22 to the cold-face 24 of the refractory delta 20. As such, if the one or more cooling apertures 30 become partially filled with dust or slag and water is not able to penetrate deep into the one or more cooling apertures 30 (e.g., only 50 percent into the apertures), the tube 34 may still remove heat from the hot-face 22 of the refractory delta 20 when the one or more cooling apertures 30 are only partially filled with water. In some embodiments of the invention the tube 34 may have a circular, oval, square, rectangular, trapezoidal, hexagonal, non-uniform, or other like shape. The tubes 34 may have diameter and depth dimensions that are similar to the dimensions of the aperture 30. The tubes 34 may be located in only a portion of the one or more apertures 30, or the tubes 34 may extend from the hot-face 22 to the cold-face 24 (or near the hot-face 22 to the near the cold-face 24). The tubes 34 may have a wall thickness that ranges from 0.02 to 4 inches, 0.03 to 1 inches, or may be 0.25 inches thick in some embodiments. In other embodiments of the invention the thickness of the tubes 34 may overlap or be outside of these ranges. In some embodiments of the invention the tubes 34 may be capped at one end. While the caps may function to initially prevent water from entering the EAF 2, as the refractory delta 20 wears the tubes 34 will also wear and/or melt, and as such one or more holes may form in the caps of the tubes 34. Water may enter the EAF 2 through these holes, but as previously discussed will simply evaporate after drawing heat away from the refractory delta 20 or as the water enters the EAF 2.

The refractory delta 20 may also have one or more channels 40 (e.g., troughs, cut-outs, ducts, or the like) that direct water applied to the refractory delta 20 into the one or more cooling apertures 30. The channels 40 may be located in one or more areas of the refractory delta 20 depending on how the water is applied the refractory delta 20. For example, water may be applied to one or more areas of a channel 40 (e.g., at the ends of the channels 40), to areas within a channel 40 (e.g., in the middle of channel 40), or may be applied directly to the one or more cooling apertures 30 (e.g., with or without the help of a channel 40). In one embodiment of the invention gravity moves the water from one area of a channel 40 to another area of channel 40 in order to deliver water to the one or more cooling apertures 30. As such sections of the one or more channels 40 may be located at different heights, or the channel 40 may be sloped to transfer water from one section of the channel 40 to another section of the channel 40. In other embodiments of the invention the cooling system 50 may pump the water through the channels 40 to the one or more apertures 30. The channels 40 may have widths that range from 1 to 3 times the diameter of the one or more apertures, however in some embodiments the widths of the channels 40 may overlap this range or be located outside of this range. The channels 40 may have depths that range from 0.25 to 3 inches, 1 to 2 inches, or other like ranges, however in other embodiments the depth of the channels 40 may overlap these ranges or be located outside of these ranges. In other embodiments of the invention, instead of using channels 40 the entire surface, or sections of the surface, of the cold-face 24 of the refractory delta 20 may be slopped to deliver water to the one or more cooling apertures 30. Moreover, in some embodiments of the invention the one or more cooling apertures 30 may have conical edges 32, or other like sloped edges, which further facilitate allowing water to fill the one or more cooling apertures 30.

Refractory deltas 20 are typically cast into the desired shape using refractory material. In some embodiments of the invention the one or more cooling apertures 30 may be drilled into the refractory material after casting based on the desired location of the one or more cooling apertures 30 in view of the anticipated hot-spots in the refractory delta 20. As such, the tube 34 (e.g., copper tube) may be inserted and coupled to the refractory delta 20 after casting and after the one or more cooling apertures 30 are drilled into the refractory delta 20. In other embodiments of the invention the refractory deltas 20 may be cast with the one or more cooling apertures already positioned in the desired locations based on the anticipated hot-spots in the refractory delta 20 during operation. Again, in this embodiment the tube 34 (e.g., copper tube) may be inserted and coupled to the refractory delta 20 after casting of the refractory delta 20. In still other embodiments of the invention, the refractory delta 20 may be cast with the tube 34 (e.g., copper tube) already positioned and located within the refractory delta 20, such that the one or more cooling apertures 30 are created based on the location of the tube 34 during casting.

Figure 5:
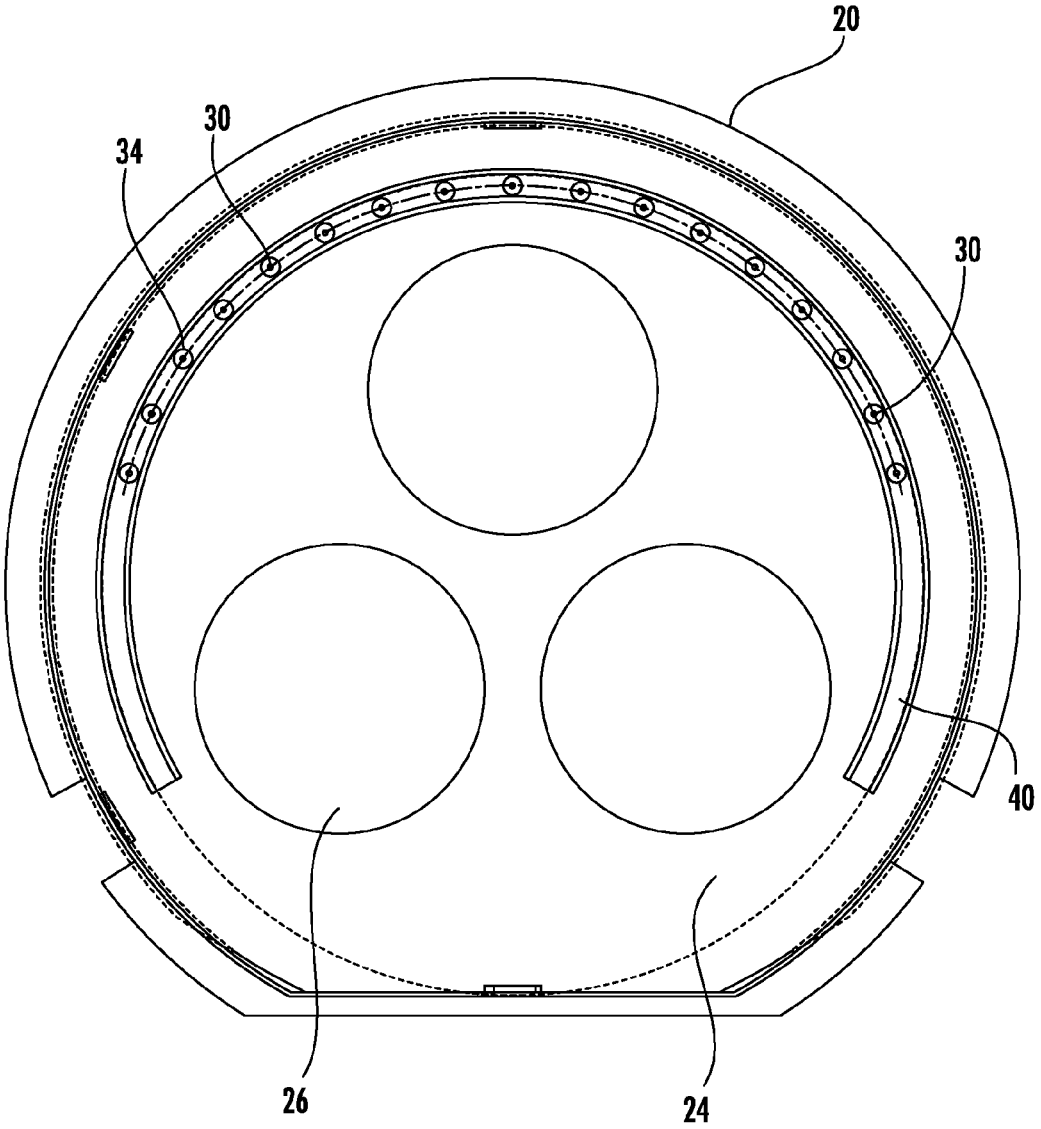
FIG. 5 illustrates a top view of a refractory delta with cooling apertures for a roof in an EAF, in accordance with an embodiment of the invention.
Figure 6:
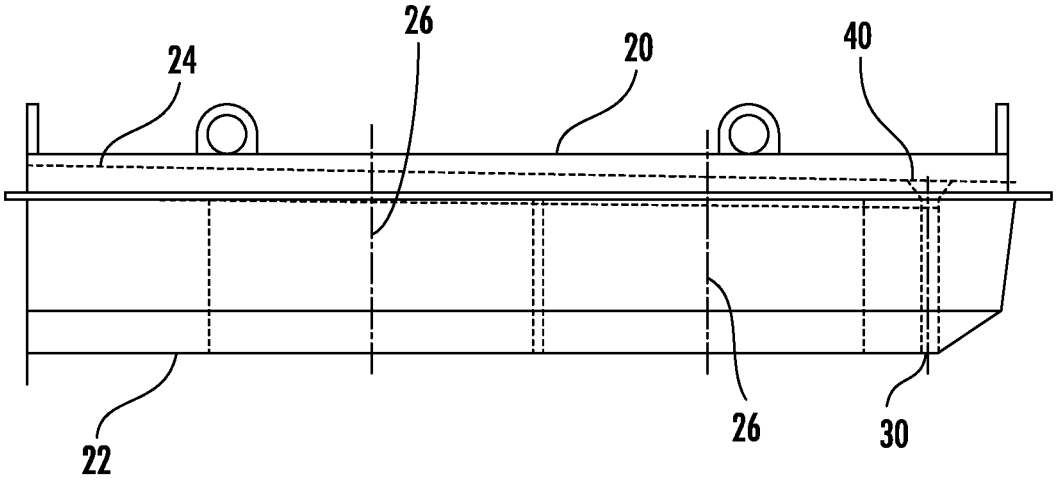
FIG. 6 illustrates a side view of a refractory delta with cooling apertures for a roof in an EAF, in accordance with an embodiment of the invention.
Figure 7:
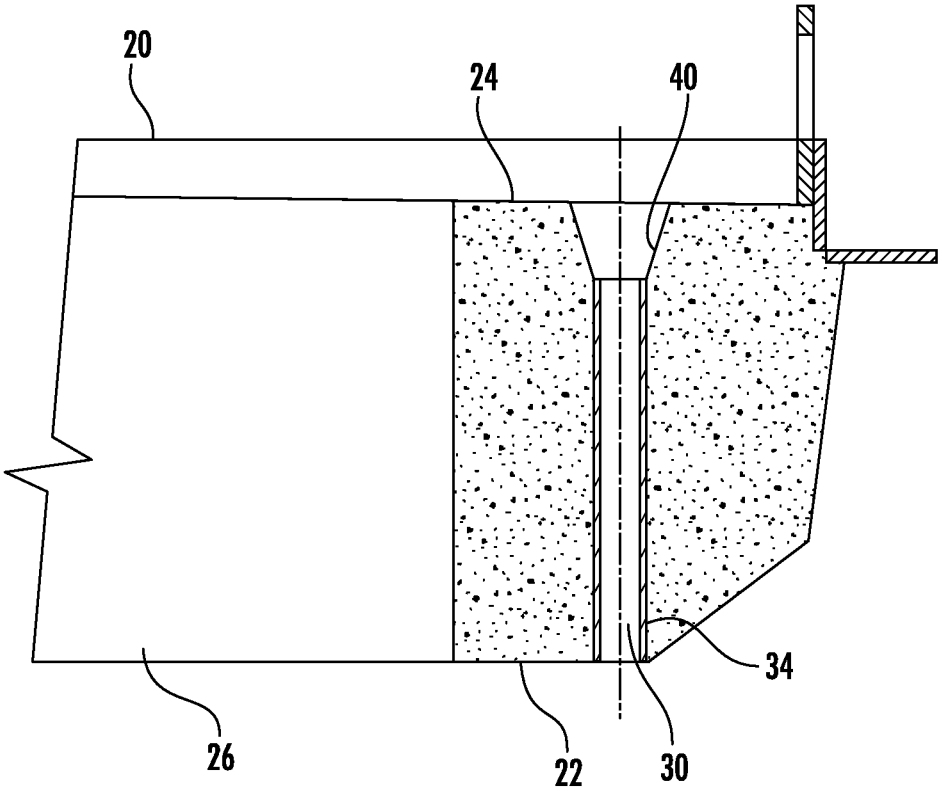
FIG. 7 illustrates an enlarged cross-sectional side view of a refractory delta with cooling apertures for a roof in an EAF, in accordance with an embodiment of the invention.
Figure 8:
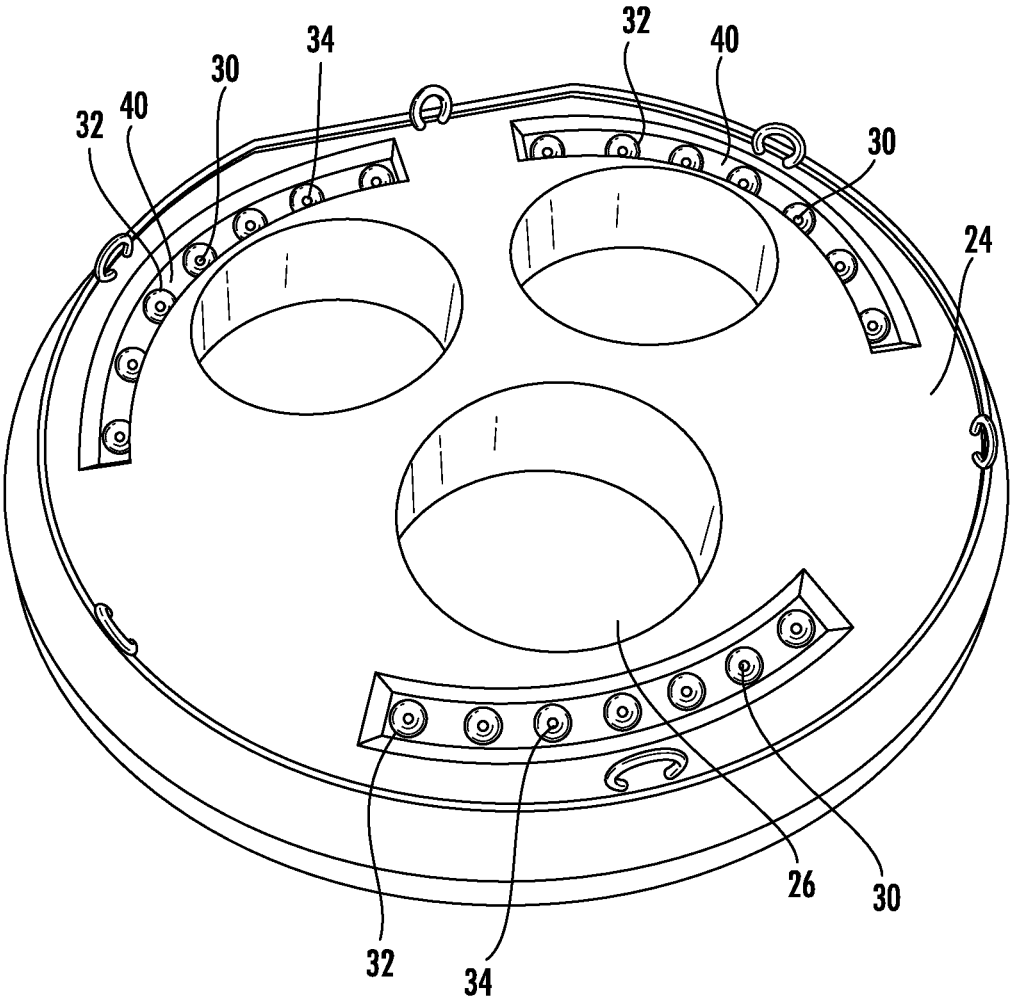
FIG. 8 illustrates a perspective view of a refractory delta for a roof in an EAF with cooling apertures located in multiple hotspots of the refractory delta, in accordance with an embodiment of the invention.

In some embodiments of the invention, the one or more cooling apertures 30 may be located randomly in the refractory delta 20. In other embodiments, the one or more cooling apertures 30 may be located in a single arch shape around the refractory delta 20, as illustrated for example in FIG. 4. Alternatively, the one or more cooling apertures 30 can be located in multiple arch shapes, as illustrated for example in FIG. 8. In still other embodiments, the one or more cooling apertures 30 may be located in other uniform or non-uniform locations in the refractory delta 20 to cool anticipated hot-spots in the refractory delta 20. In one embodiment of the invention seven (7) apertures 30 may be located in an arch shape. In other embodiments of the invention seventeen (17) apertures 30 may be located in an arch shape, as illustrated in FIG. 5. The number of apertures 30 located in the refractory delta 30 may be determined based on the individual wear factors for different EAFs and different steelmaking processes, as previously described.

Figure 9:
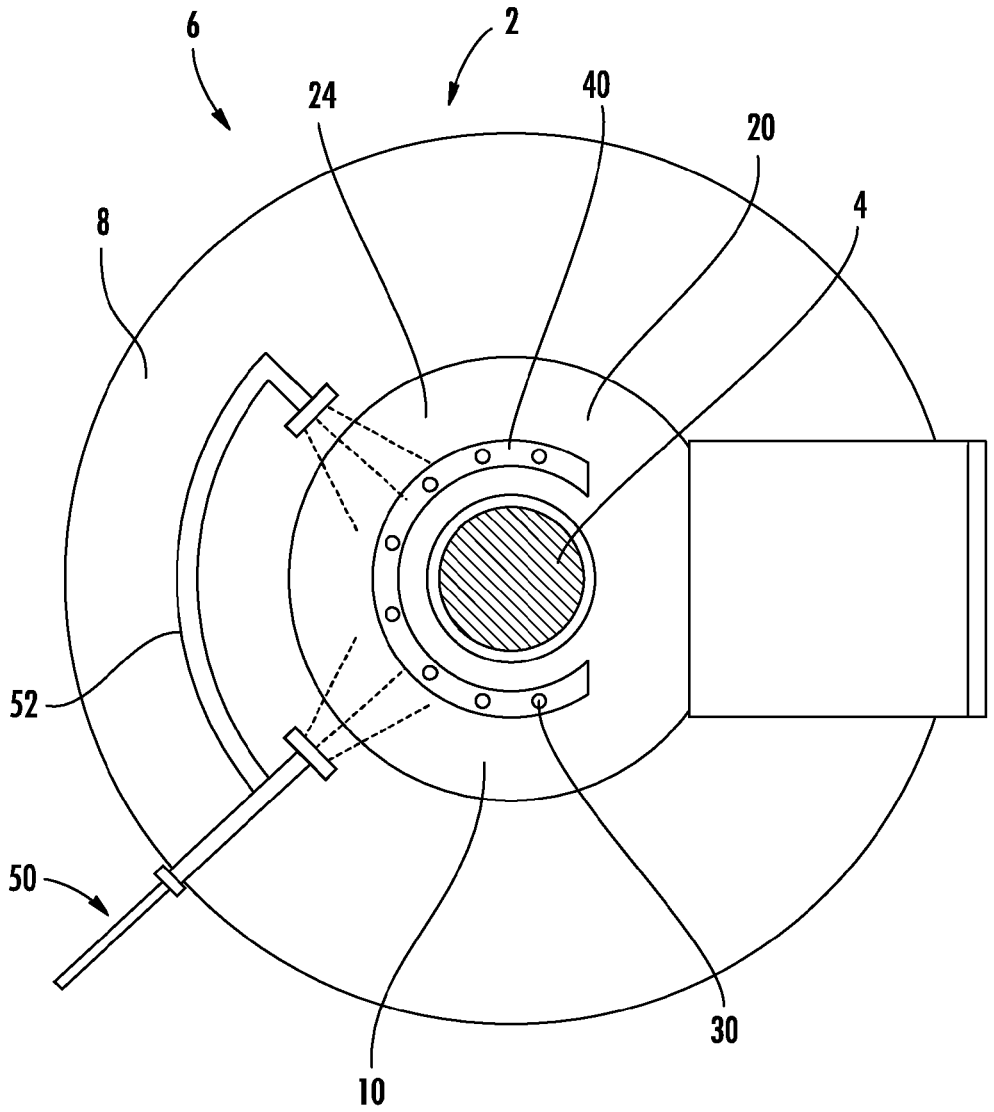
FIG. 9 illustrates top view of an EAF roof with a water supply apparatus, in accordance with an embodiment of the invention.
Figure 10:
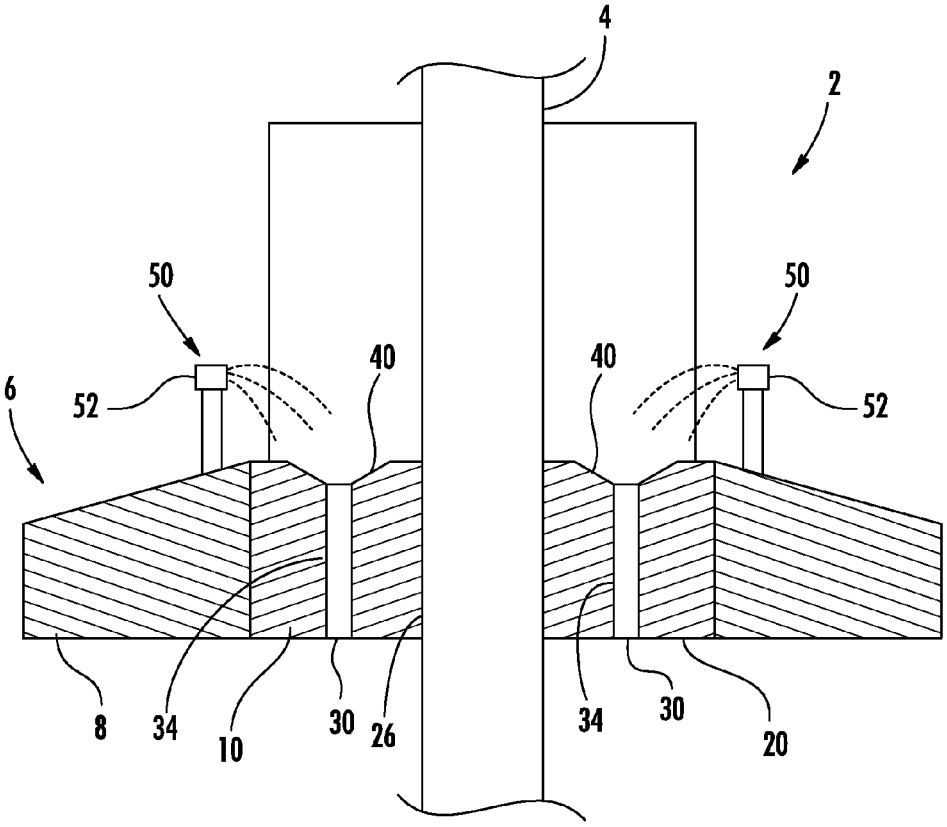
FIG. 10 illustrates a cross-sectional side view of an EAF roof with a water supply apparatus, in accordance with an embodiment of the invention.
Figure 11:
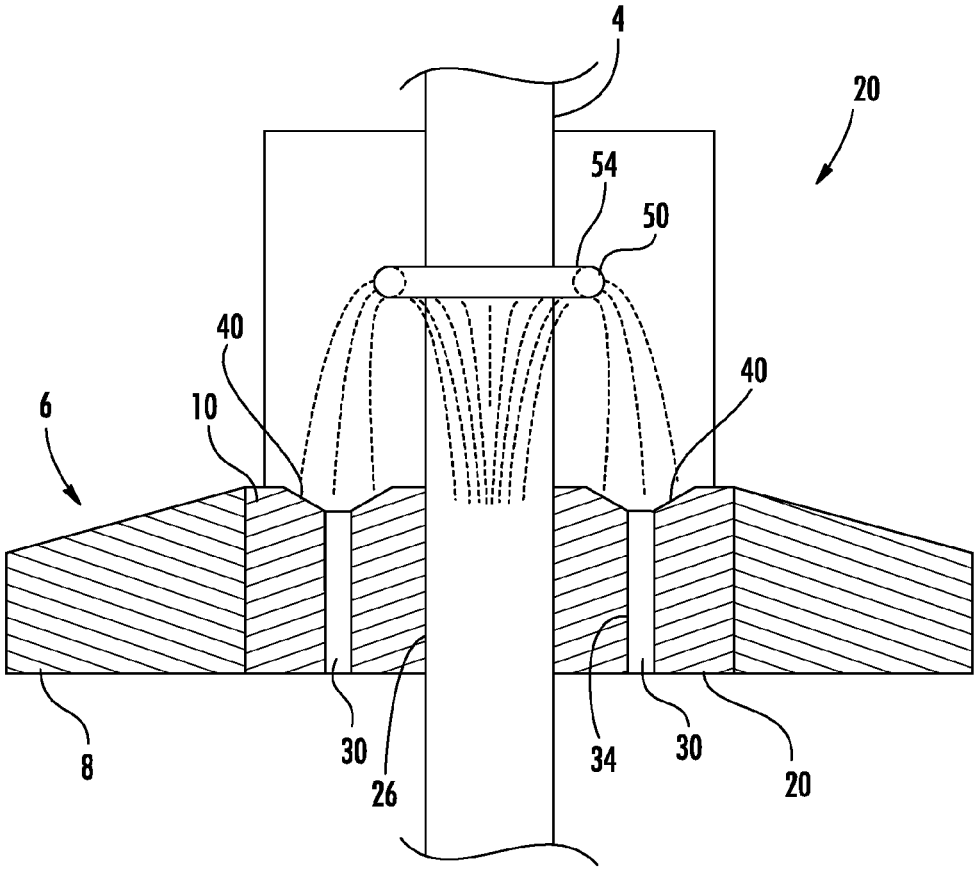
FIG. 11 illustrates a cross-sectional side view of an EAF roof with a water supply apparatus, in accordance with an embodiment of the invention.

FIG. 9 illustrates a top view of the roof 6 of an EAF 2 that utilizes a refractory cooling system 52 to deliver water to the one or more cooling apertures 30 in the refractory delta 20. FIG. 10 illustrates a cross-sectional view of the roof 6 of the EAF 2 in FIG. 9 illustrating the one or more cooling apertures 30 and the one or more channels 40 in the refractory delta 20. As illustrated in FIGS. 9 and 10 the water may be delivered by directing water from a manifold in the refractory cooling system 52 into a channel 40 that captures the water and delivers the water to the one or more cooling apertures 30 located in the base of the channel 40. As illustrated in FIG. 11, in other embodiments of the invention the water cooling system 50 may be an electrode cooling system 54 in which some water that is typically used to cool the electrodes 6 is diverted to the channel 40 in the refractory delta 20, or alternatively diverted directly to the one or more cooling apertures 30.

Utilizing the refractory delta 20 described herein, and the cooling systems described herein, the life of the refractory delta 20 may be extended by a factor range of 1.5 to 3 times, for example the life of the refractory delta 20 may be extended an average factor of 2 times. In other embodiments of the invention the life of the refractory delta may overlap these ranges or be located outside of these ranges. In one embodiment, for example, the average life of the refractory delta 20 may be extended from an average of 300 heats up to approximately an average of 800 heats. One heat is a single operation of the EAF 2 from the charge of scrap metal, to melting of the scrap metal, to tapping and transferring of the molten metal to a ladle (or other collection area). In other embodiments of the invention the range of the average life of the refractory delta 20 of the present invention may be improved to between 500 to 1,100 heats, between 600 to 900 heats, between 700 to 900 heats, or other ranges that overlap these ranges or fall outside of these ranges.

Figure 13:
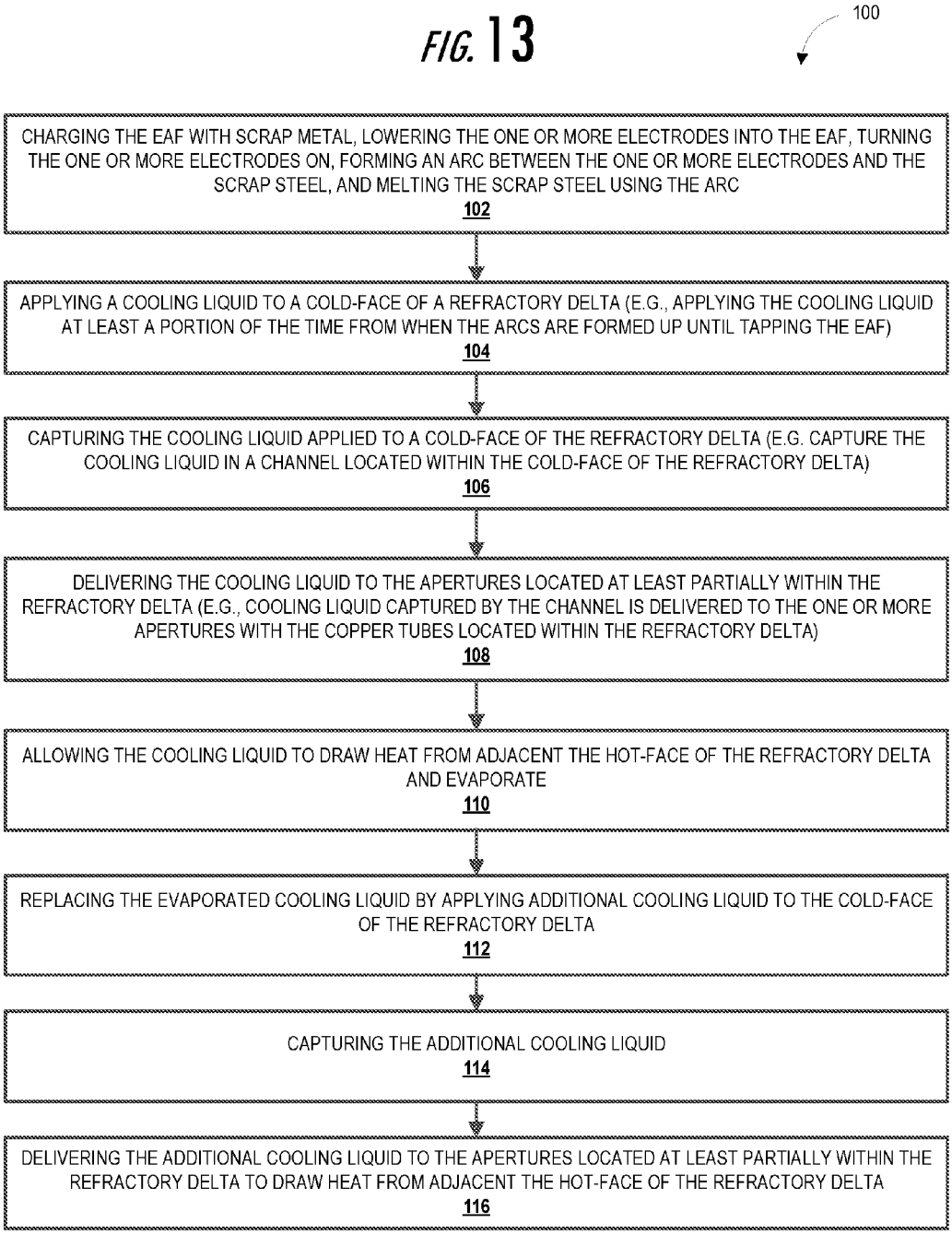
FIG. 13 illustrates a process flow for cooling a refractory delta for a roof in an EAF, in accordance with an embodiment of the invention.

FIG. 13 illustrates a method of cooling a refractory delta 100 during a steel manufacturing process. In order to manufacture steel in an EAF 2, as illustrated by block 102, the EAF 2 is charged with scrap steel in the beginning of the process (in some types of EAFs additional charges of steel may be added after melting has begun). As further illustrated by block 102 in FIG. 13, the one or more electrodes 4 are lowered into the EAF 2 through the electrode apertures 26 in the refractory delta 20. As this point the scrap steel is near the roof 6 of the EAF 2, and as such when the electrodes 4 are turned on the arcs formed with the scrap steel are located near the refractory delta 20. At this point in time the refractory delta 20 is susceptible to damage because of the close proximity of the arcs. After the arcs are formed the current passing through the scrap steel and the radiant heat from the arcs will melt the scrap steel, and the radiant heat from the arcs will begin to wear the refractory delta 20.

As illustrated by block 104 of FIG. 13, a cooling liquid is applied to the cold-face 24 of the refractory delta 20. As discussed herein, the cooling liquid may be applied using a refractory cooling system 52, such as a manifold. In other embodiments, the cooling liquid may be applied by directing a portion of the water from the electrode cooling system 54 to the refractory delta 20. Other cooling systems 50 may be utilized to deliver water or other cooling liquids to the one or more cooling apertures 30. The cooling liquid may be applied at any time during the steelmaking process, but in some embodiments may generally be applied when the arcs are formed up until the EAF 2 is tapped.

Block 106 of FIG. 13 illustrates that the channel 40 and/or the one or more cooling apertures 30 captures the cooling liquid applied to the cold-face 24 of the refractory delta 20. For example, as illustrated by FIG. 12 the channel 40 located in the cold-face 24 surface of the refractory delta 20 may capture the water. As illustrated by block 108, the channel 40 may deliver the cooling liquid to the one or more cooling apertures 30 located in the refractory delta 20. As such, one or more channels 40 may be in communication with one or more cooling apertures 30 in order to allow the cooling water to enter the one or more cooling apertures 30.

As illustrated by block 110 in FIG. 13, the cooling liquid that fills the one or more cooling apertures 30 and/or the tubes 34 located in the one or more cooling apertures 30, alone, or in combination, draw heat from the refractory delta 20 (e.g., proximate the hot-face 22 of the refractory delta 20) as the cooling liquid passes through the one or more cooling apertures 30. Some of the cooling liquid may evaporate as it passes through the one or more apertures 30, or some of the cooling liquid may enter the EAF 2 and evaporate within the EAF 2. As illustrated by block 112 of FIG. 13, the evaporated cooling liquid is replaced with additional cooling liquid from the cooling system 50. The additional cooling liquid is captured (e.g., by the channel 40) as illustrated in block 114 of FIG. 13. The additional cooling liquid is delivered to the one or more cooling apertures 30 from which the cooling liquid has evaporated in order to draw additional heat away from the refractory delta 20. This process is continued during the steelmaking process as desired in order to remove heat from the refractory delta 20, and more specifically remove heat from near the hot-face 22 of the refractory delta 20 in order to prolong the life of the refractory delta 20.

As illustrated in FIG. 12, in some embodiments of the invention, a skin 60 of slag and/or dust at least partially covers the refractory delta 20, and more particularly covers the one or more cooling apertures 30 on the hot-face 24 side of the refractory delta 20. The skin 60 that may cover the one or more cooling apertures 30 may at least partially prevent water (or other cooling liquid) from entering the EAF 2. As such the water may fill the one or more cooling apertures 30. FIG. 12 further illustrates that in some embodiments, the skin 60 of slag and/or dust may extend up into the one or more cooling apertures 30 in the refractory delta 20. Even if the one or more apertures 30 become blocked or partially block the water will fill the apertures 30, draw heat from the surrounding refractory material, and evaporate. The evaporated water will be replaced by additional cooling water to continue to cool the refractory delta 20. This is the same process that would occur if the one or more apertures 30 do not extend completely through the refractory delta 20, or if a cap was placed on the end of the tube 34 to prevent water from entering the EAF 2.

The present invention described herein may be utilized in locations of the EAF 2 other than the refractory delta 20. For example, the features described herein may be utilized in refractory material located in the outer roof 8 or in sections of the furnace walls 14 that would not be covered with molten metal during operation. In other embodiments, the invention described herein may be used with refractory bricks that are built up in various locations within the EAF instead of, or in addition to, being cast into a refractory delta 20. In other embodiments, the present invention described herein may be utilized in furnaces in other industries outside of the steel industry in which refractory material is used and for which the life of the refractory material can be extended by utilizing the invention described herein.

Specific embodiments of the invention are described herein. Many modifications and other embodiments of the invention set forth herein will come to mind to one skilled in the art to which the invention pertains, having the benefit of the teachings presented in the foregoing descriptions and the associated drawings. Therefore, it is to be understood that the invention is not to be limited to the specific embodiments disclosed and that modifications and other embodiments and combinations of embodiments are intended to be included within the scope of the appended claims. Although specific terms are employed herein, they are used in a generic and descriptive sense only and not for purposes of limitation.

What is claimed is:

1. A refractory delta, comprising:

refractory material having a cold-face side and a hot-face side, wherein the refractory material is a unitary portion of material;

one or more electrode apertures in the refractory material for receiving one or more electrodes;

a plurality of cooling apertures extending from the cold-face side of the refractory material to adjacent the hot-face side of the refractory material; and wherein the one or more cooling apertures are configured to receive a cooling liquid that draws heat from the refractory material and evaporates to allow replacement cooling liquid to further draw heat from the refractory material.

2. The refractory delta of claim 1, wherein the plurality of cooling apertures are through holes that extend from the cold-face side through the hot-face side of the refractory material.

3. The refractory delta of claim 1, further comprising a copper tube in at least a portion of one or more of the plurality of cooling apertures.

4. The refractory delta of claim 1, wherein the cold-face side of the refractory delta comprises:

a channel;

wherein the channel communicates with the plurality of cooling apertures; and wherein when the refractory delta is located within a roof of an electric arc furnace (EAF) and the channel directs cooling liquid from a cooling system and aids in delivering the cooling liquid to the one or more cooling apertures.

5. The refractory delta of claim 1, wherein the cold-face side of the refractory delta comprises:

a sloped surface;

wherein the sloped surface communicates with the plurality of cooling apertures; and wherein when located within a roof of an electric arc furnace (EAF) the sloped surface directs cooling liquid from a cooling system and aids in delivering the cooling liquid to the plurality of cooling apertures.

6. A roof for an electric arc furnace (EAF), comprising:

an outer roof section;

an inner roof section comprising:

a refractory material having a cold-face side and a hot-face side, wherein the refractory material is a unitary portion of material;

one or more electrode apertures for receiving one or more electrodes;

a plurality of cooling apertures extending from the cold-face side of the refractory material to adjacent the hot-face side of the refractory material; and wherein the plurality of cooling apertures are configured to receive a cooling liquid that draws heat from the refractory material and evaporates to allow replacement cooling liquid to further draw heat from the refractory material.

7. The roof for the EAF of claim 6, wherein the plurality of cooling apertures are through holes that extend from the cold-face side through the hot-face side of the refractory material.

8. The roof for the EAF of claim 6, further comprising a copper tube in at least a portion of one or more of the plurality of cooling apertures.

9. The roof for the EAF of claim 6, further comprising:
a channel or a sloped surface;
wherein the channel or the sloped surface communicates with the plurality of cooling apertures; and
wherein the channel or the sloped surface directs cooling liquid from a cooling system and aids in delivering the cooling liquid to the plurality of cooling apertures.

10. The roof for the EAF of claim 9, wherein the cooling liquid comprises water and the cooling system is a water supply manifold or an electrode cooling system.

11. A refractory delta cooling system, comprising:
an electric arc furnace (EAF) roof with an outer roof section and an inner roof section;
wherein the inner roof section comprises:
a refractory material;
a cold-face side and a hot-face side;
one or more electrode apertures for receiving one or more electrodes;
a plurality of cooling apertures extending from the cold-face side of the refractory material to adjacent the hot-face side of the refractory material;
wherein the plurality of cooling apertures are configured to receive a cooling liquid that draws heat from the refractory material and evaporates to allow replacement cooling liquid to further draw heat from the refractory material; and
a cooling system, wherein the cooling system directs a cooling liquid to the plurality of cooling apertures.

12. The refractory cooling system of claim 11, wherein the plurality of cooling apertures are through holes that extend from the cold-face side through the hot-face side of the refractory material.

13. The refractory cooling system of claim 11, wherein the inner roof section further comprises a copper tube in at least a portion of one or more of the plurality of cooling apertures.

14. The refractory cooling system of claim 11, wherein the cold-face side of the refractor material of the inner roof section further comprises:
a channel or a sloped surface;
wherein the channel or the sloped surface communicates with the plurality of cooling apertures; and
wherein the channel or the sloped surface directs cooling liquid from the cooling system and aids in delivering the cooling liquid to the plurality of cooling apertures.

15. A method for cooling a refractory delta comprising:
applying a cooling liquid to a cold-face of refractory material of the refractory delta in a roof of an electric arc furnace (EAF) through the use of a cooling system;
capturing the cooling liquid in a plurality of cooling apertures, wherein the plurality of cooling apertures extend from the cold-face side of the refractory material to adjacent a hot-face side of the refractory material;
applying additional cooling liquid to the cold-face of the refractory material in the roof of the EAF through the use of the cooling system as the cooling liquid evaporates from the plurality of cooling apertures; and
capturing the additional cooling liquid in the plurality of cooling apertures.

16. The method of claim 15, wherein the plurality of cooling apertures are through holes that extend from the cold-face side through the hot-face side of the refractory material.

17. The method of claim 15, wherein the plurality of cooling apertures comprise a copper tube in at least a portion of one or more of the plurality of cooling apertures; and wherein capturing the cooling liquid and the additional cooling liquid in the plurality of cooling apertures comprises capturing the cooling liquid and the additional cooling liquid in the copper tube.

18. The method of claim 15, wherein the cold-face side of the refractory delta comprises:
a channel or a sloped surface;
wherein the channel or the sloped surface communicates with the plurality of cooling apertures; and
wherein applying the cooling liquid to the cold-face of the refractory delta in the roof of the EAF comprises applying the cooling liquid to the channel or the sloped surface that directs the cooling liquid and aids in delivering the cooling liquid to the plurality of cooling apertures.

19. The method of claim 18, wherein applying the cooling liquid and applying the additional cooling liquid comprises applying water and the water is supplied from a water supply manifold or an electrode cooling system.

20. A refractory delta cooling system, comprising:
an electric arc furnace (EAF) roof comprising an outer roof section and an inner roof section;
wherein the inner roof section is a refractory delta and comprises:
a refractory material;
a cold-face side and a hot-face side;
one or more electrode holes for receiving one or more electrodes; and
a cooling system, wherein the cooling system directs a cooling liquid to the cold-face side of the refractory delta, and wherein the cooling liquid facilitates the transfer of heat from the hot-face side to the cold-face side and evaporates to allow replacement cooling liquid to further facilitate the transfer of heat from the hot-face side to the cold-face side.

21. A refractory delta, comprising:
refractory material having a cold-face side and a hot-face side;
one or more electrode apertures for receiving one or more electrodes;
one or more cooling apertures extending from the cold-face side of the refractory material through the hot-face side of the refractory material; and
wherein the one or more cooling apertures are configured to receive a cooling liquid that draws heat from the refractory material and evaporates to allow replacement cooling liquid to further draw heat from the refractory material.

* * * * *